US007168433B2

(12) United States Patent
De LaForcade

(10) Patent No.: US 7,168,433 B2
(45) Date of Patent: Jan. 30, 2007

(54) PACKAGING AND DISPENSING DEVICE

(75) Inventor: Vincent De LaForcade, Rambouillet (FR)

(73) Assignee: L'Oréal S.A., Paris (FR)

( * ) Notice: Subject to any disclaimer, the term of this patent is extended or adjusted under 35 U.S.C. 154(b) by 98 days.

(21) Appl. No.: 10/873,172

(22) Filed: Jun. 23, 2004

(65) Prior Publication Data

US 2005/0025557 A1 Feb. 3, 2005

Related U.S. Application Data

(60) Provisional application No. 60/485,711, filed on Jul. 10, 2003.

(30) Foreign Application Priority Data

Jun. 23, 2003 (FR) ..... 03 07546

(51) Int. Cl.
*A45D 24/22* (2006.01)

(52) U.S. Cl. ..... 132/116; 401/131; 222/463

(58) Field of Classification Search ..... 132/313, 132/142, 112–116; 401/131, 152, 156; 222/463, 222/215; 215/270, 382, 379, 380; 220/603, 220/631

See application file for complete search history.

(56) References Cited

U.S. PATENT DOCUMENTS

| | | | | |
|---|---|---|---|---|
| 373,701 | A * | 11/1887 | Underwood | 401/131 |
| D87,255 | S * | 6/1932 | Fuerst | D9/522 |
| 3,054,535 | A * | 9/1962 | Clarey | 222/215 |
| 3,366,284 | A * | 1/1968 | Marona et al. | 222/211 |
| 3,612,133 | A * | 10/1971 | Jarund | 383/9 |
| 3,885,698 | A | 5/1975 | Lebel et al. | |
| 4,209,027 | A | 6/1980 | Morganroth | |
| 4,571,106 | A | 2/1986 | Scuderi | |
| 4,928,582 | A * | 5/1990 | Elfverson | 454/155 |
| 5,024,243 | A * | 6/1991 | Snyder | 132/116 |
| 6,132,123 | A * | 10/2000 | Gueret | 401/129 |
| 6,286,518 | B1 * | 9/2001 | Laporte | 132/116 |
| 2002/0012565 | A1 | 1/2002 | Sima et al. | |

FOREIGN PATENT DOCUMENTS

| | | |
|---|---|---|
| FR | 2 163 809 | 7/1973 |
| FR | 2 736 331 | 1/1997 |
| GB | 2 332 652 | 6/1999 |

OTHER PUBLICATIONS

English language Derwent Abstract of FR 2 736 331, Jan. 10, 1997.

* cited by examiner

*Primary Examiner*—Todd E. Manahan
*Assistant Examiner*—Rachel A. Running
(74) *Attorney, Agent, or Firm*—Finnegan, Henderson, Farabow, Garrett & Dunner, L.L.P.

(57) ABSTRACT

Various embodiments of a dispensing device are disclosed. The device may include a receptacle having a first face and at least one outlet orifice for dispensing a substance contained in the receptacle. The receptacle may be configured to be rested on a horizontal plane surface with the first face being in contact with the horizontal plane surface. The first face may be configured such that while the receptacle is rested on the horizontal plane surface with the first face being in contact with the horizontal plane surface, a decrease in the quantity of substance in the receptacle causes the receptacle to tilt without causing the substance to run out through said at least one outlet orifice.

43 Claims, 3 Drawing Sheets

PACKAGING AND DISPENSING DEVICE

This application claims the benefit under 35 U.S.C. § 119(e) of U.S. Provisional Application No. 60/485,711, filed on Jul. 10, 2003.

The present invention relates to packaging and dispenser devices for cosmetic products (where the term "cosmetic products" includes care products as well as other products, such as hair coloring, dying, or treatment products). Some exemplary embodiments of the invention relate to devices for applying coloring products to, for example, locks of hair.

When a person desires to color a selected location of the hair (e.g., locks of hair) with a color different from that of the remainder of the hair, care must be taken to apply the hair-coloring product only at that selected location. At the same time, the person applying the product must also pay close attention to the locks of hair at other locations that have or have not already been colored. During such a coloring process, it may be often necessary to put down the receptacle containing the hair-coloring product in a hurry to, for example, fix the hair or apply another product and then to quickly pick it up again to apply the product in the same or another location. Under such circumstances, the person applying the product may find it difficult to pay careful attention to the manner in which the receptacle containing the product is put down and/or picked up. Some conventional receptacles having a generally cylindrical, elongated shape may also have an increased risk of being toppled over accidentally while being put down or picked up. Unfortunately, hair-coloring products are often likely to leave behind a stain that is difficult to remove from any medium onto which they might accidentally be spilled or leaked. It is therefore appropriate to ensure that there is no accidental spilling or leakage of the product.

In addition, because hair-coloring products are often relatively viscous, it may take a relatively long time for a product to flow from one location to another within a receptacle and, therefore, delivery of the product may be delayed each time the user picks up the receptacle to apply the product. This makes the treatment process lengthier and more difficult to perform.

Finally, coloring products may comprise two components, such as, for example, an oxidizer and a coloring agent, for mixing extemporaneously. With conventional receptacles, however, these components are found to be relatively difficult to mix together.

Therefore, there exists a need for a dispensing device which may be easily put down and/or picked up without paying any particular attention to the manner in which the device is put down and/or picked up, so as to reduce the risk of accidental spillage of the product contained in the device.

There also exists a need for a device which may allow the user to quickly dispense a substance from the device that has previously been put down, without having to wait for a long period of time before the substance can be dispensed again.

There also exists a need for a device that may be relatively simple and/or cheap to manufacture, so as to be compatible with mass marketing.

Although the present invention may obviate one or more of the above-mentioned needs, it should be understood that some aspects of the invention may not necessarily obviate one or more of those needs.

In the following description, certain aspects and embodiments will become evident. It should be understood that the invention, in its broadest sense, could be practiced without having one or more features of these aspects and embodiments. It should be understood that these aspects and embodiments are merely exemplary.

In one aspect of the invention, as embodied and broadly described herein, the invention may provide a dispensing device comprising a receptacle comprising a first face, the receptacle being configured to contain a substance and being configured to be rested on a horizontal plane surface with the first face being in contact with the horizontal plane surface. The device may also comprise at least one outlet orifice for dispensing the substance contained in the receptacle. The first face may be configured such that while the receptacle is rested on the horizontal plane surface with the first face being in contact with the horizontal plane surface, a decrease in the quantity of substance in the receptacle causes the receptacle to tilt without causing the substance to run out through said at least one outlet orifice.

In some aspects, the device may comprise an applicator portion comprising at least one outlet orifice. As used herein, the term "applicator portion" refers to a part of a dispensing device that is configured to apply a substance to a body portion via contact with the body portion. For example, the applicator portion may include at least one applicator element, such as a bristle, a tooth, pad, etc., that is configured to apply a substance via contact with a body portion (e.g., hair, skin, nails, eyelashes, eyebrows, lips, etc.). In contrast, a device that includes merely a spraying of product from an orifice (e.g., an aerosol spray or pump spray) without having part that contacts a body portion to apply a substance does not have an applicator portion. Although some embodiments described herein include an applicator portion, it should be understood that certain embodiments might not have such structure.

In another aspect of the invention, the first face may be configured such that the tilting of the receptacle in response to a decrease in the quantity of the substance in the receptacle causes the outlet orifice to move closer to the horizontal plane surface.

In some embodiments, when the receptacle is put down after use, a certain quantity of substance remaining inside the receptacle may move closer to the outlet orifice, thereby reducing the time needed for the substance to reach the outlet orifice for the next use. This may enable a user to treat the hair more quickly, with greater accuracy and/or more enhanced comfort.

In still another aspect of the invention, the receptacle may be configured such that, while the receptacle is rested on the horizontal plane surface with the first face being in contact with the horizontal plane surface and while the receptacle contains the substance, the center of gravity of the receptacle shifts towards the outlet orifice as the quantity of substance in the receptacle decreases.

In yet still another aspect, the receptacle may be configured such that, while the receptacle is rested on the horizontal plane surface with the first face being in contact with the horizontal plane surface and while the receptacle contains the substance, the receptacle tilts about geometric instantaneous pivot axes (e.g., each of the pivot axes being defined by a line extending parallel to the horizontal plane surface and passing through a contact point between the first face and the horizontal plane surface) that are parallel to one another and to the horizontal plane surface as the quantity of substance in the receptacle in the receptacle decreases.

According to another aspect of the invention, the receptacle may be configured such that, while the receptacle is rested on the horizontal plane surface with the first face being in contact with the horizontal plane surface, any quantity of substance contained in the receptacle defines in one-to-one correspondence a corresponding stable equilibrium position of the receptacle.

Therefore, the receptacle may be configured such that the receptacle may rest in stable equilibrium regardless of the level of substance in the receptacle.

In another aspect of the invention, the first face may be defined by a wall having a substantially constant thickness. In still another aspect of the invention, the receptacle may not be provided with any ballast (i.e., in contrast to the subject matter disclosed in U.S. Pat. No. 3,885,698). For example, the receptacle may be made without any mass fitted thereto, so as to maintain the manufacturing cost relatively low.

According to still another aspect of the invention, the receptacle may have a length and a width. The width may range from about 75% to about 125% of the length. In various exemplary embodiments, the width may range from about 85% to about 115% of the length. These exemplary proportions of the length and width may make the receptacle easier to mix a plurality of components or substances (e.g., an oxidizer and a coloring agent) inserted into the receptacle. It should be understood, however, that any other relative proportion between the length and width may be possible.

An aspect of the present invention may comprise a dispenser head, which may include an applicator portion. In various exemplary embodiments, the receptacle may comprise an elongated body defining a longitudinal axis, and the dispenser head may extend along a dispenser head axis that may be non-parallel to the longitudinal axis. For example, an angle between the dispenser head axis and the longitudinal axis of the elongated body may range from about 10° to about 30°. In an exemplary embodiment, the angle may range from about 15° to about 25°. It should be understood, however, that the angle may also be less than 10° or more than 30°.

In still another aspect of the invention, the receptacle may comprise a neck or any other assembly portion on which the dispenser head may be fixed or fastened. In an exemplary embodiment, the dispensing device may comprise a screw fastener to fasten the dispenser head to the neck. In another exemplary embodiment, the dispensing device may comprise a snap fastener to fasten the dispenser head to the neck. It should be understood that any other type of fastening or assembly mechanisms may alternatively or additionally be used.

In yet still another aspect, the neck and body of the receptacle may be made as a single-piece molding. In various exemplary embodiments, the receptacle may be made of a plastics material, such as, for example, polyethylene (PE), polypropylene (PP), polyolefins, polyamide, polyester, or polyvinyl chloride (PVC).

In one aspect of the invention, the neck may include a portion in relief enabling the dispenser head to be positioned in a predetermined angular orientation relative to the body of the receptacle, particularly when the dispenser head is held to the neck by snap-fastening.

In another aspect of the invention, the applicator portion may be disposed on the dispenser head. The applicator portion may be configured to comb hair. In various exemplary embodiments, the applicator portion may comprise at least one tooth. The at least one tooth may extend in a direction substantially parallel to the dispenser head axis while the receptacle is rested on the horizontal plane surface with the first face being in contact with the horizontal plane surface.

In still another aspect of the invention, the applicator portion may comprise at least one row of teeth. In an exemplary embodiment, the applicator portion may comprise two substantially parallel rows of teeth. The outlet orifice may open out between the two substantially parallel rows of teeth. In a variant, at least one tooth may be hollow and the outlet orifice may open out at the end of the hollow tooth or in the vicinity of that end.

In yet still another aspect, the applicator portion may comprise at least one row of teeth (e.g. two rows), with the row extending in a direction substantially parallel to the horizontal plane surface when the receptacle is rested thereon with the first face being in contact therewith.

The applicator portion may be made of a plastics material, such as, for example, polyethylene (PE), polypropylene (PP), polyolefins, polyamide, polyester, polyvinyl chloride (PVC), or polymethyl methacrylate. In various exemplary embodiments, the applicator portion may be made by an injection molding process.

In an aspect of the invention, the applicator portion may comprise something other than a tooth. For example, the applicator portion may comprise, in addition or in the alternative, a tuft of bristles and/or a foam.

In another aspect of the invention, the first face may have an outwardly-facing, generally convex shape. In still another aspect of the invention, the receptacle may comprise a second face opposite the first face. The second face may comprise at least one indentation. The indentation may be positioned substantially at the center of the second face. The portion of the second face other than the indentation may have an outwardly-facing, generally concave shape.

Still another aspect of the invention may comprise a cosmetic product contained in the receptacle. The cosmetic product may comprise a hair product. For example, the hair product may comprise a hair-coloring product.

In yet still another aspect, a substance-containing capacity of the receptacle may range from about 10 mL to about 500 mL. In various exemplary embodiments, the substance-containing capacity of the receptacle is about 150 mL.

In another aspect of the invention, the device may be configured such that product is dispensed from the outlet orifice by manually pressing (e.g., squeezing) the receptacle so as to reduce an inner volume of the receptacle.

In still another aspect, the device may be configured so that the substance may have a level substantially parallel to the horizontal plane surface while the receptacle is rested on the horizontal plane surface with the first face being in contact with the horizontal plane surface. In yet still another aspect of the invention, the at least one outlet orifice defines an elevation with respect to the horizontal plane surface, and the device may be configured such that the level of the substance in the receptacle may remain below the elevation of the at least one outlet orifice while the receptacle is rested on the horizontal plane surface with the first face being in contact with the horizontal plane surface.

Aside from the structural arrangements set forth above, the invention could include a number of other arrangements, such as those explained hereinafter. It is to be understood that both the foregoing description and the following description are exemplary.

The accompanying drawings, which are incorporated in and constitute a part of this specification, illustrate a number of non-limiting embodiments of the invention and together with the description, serve to explain the principles of the invention.

Reference will now be made in detail to the exemplary embodiments of the invention, examples of which are illustrated in the accompanying drawings. Wherever possible, the same reference numbers will be used throughout the drawings to refer to the same or like parts. It is to be understood that both the foregoing general description and the following detailed description are exemplary and explanatory only and are not restrictive of the invention, as claimed.

Figure 1:
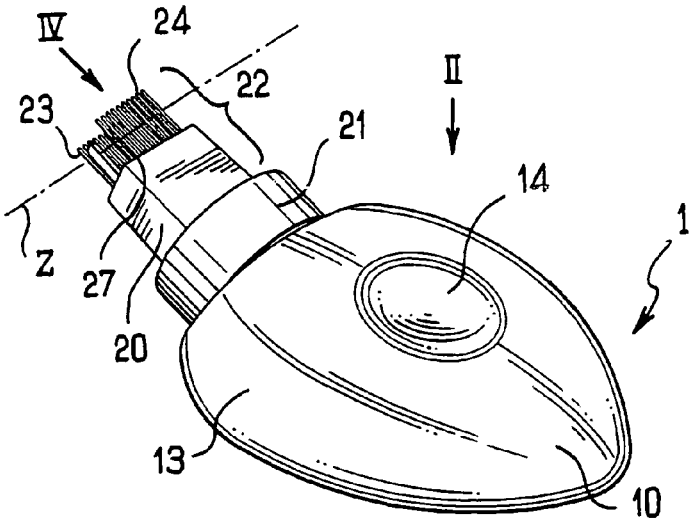
FIG. 1 is a perspective view of a device for applying a substance, according to an exemplary embodiment of the invention.
Figure 2:
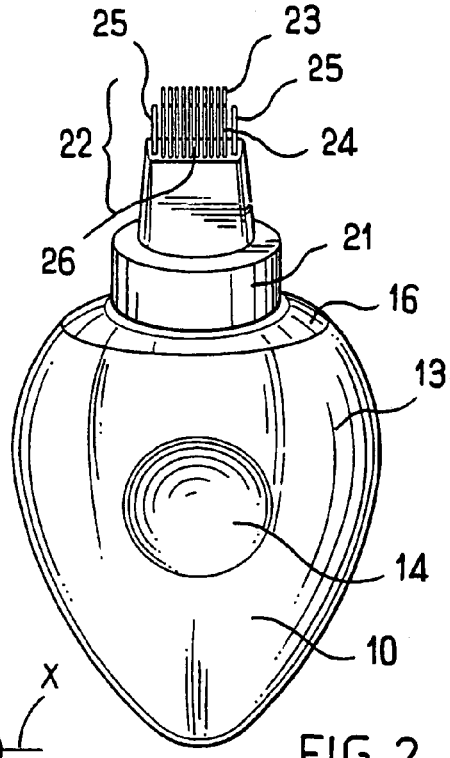
FIG. 2 is a plan view of the device of FIG. 1 along the direction of arrow II.

FIGS. 1 and 2 show perspective and side views of a device for packaging and applying a substance, according to an exemplary embodiment of the invention. The device 1 may comprise a receptacle 10 configured to contain a substance, such as, for example, a hair-coloring product, and a dispenser head 20 configured to apply the substance contained in the receptacle 1. While the present invention will be described in connection with particular devices for applying hair-coloring products, the present invention may also be used to apply any other hair products or any other cosmetic products. It should also be understood that the present invention may be used to apply products other than cosmetic products.

Figure 3:
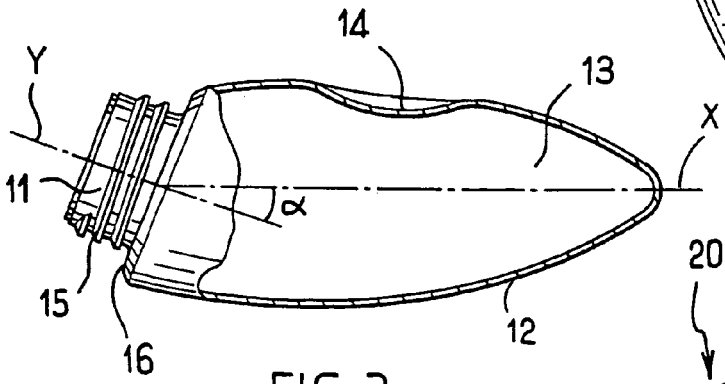
FIG. 3 is a side cross-sectional view of a receptacle of FIG. 1, shown without a dispenser head.

As best shown in FIG. 3, the receptacle 10 may comprise a body elongated along a longitudinal axis X and having a generally flat shape. At or near one end of the receptacle 10 along the longitudinal axis X, the receptacle 10 may have an opening through which the substance contained in the receptacle 10 may flow. The receptacle 10 may comprise a neck 11 that may define the opening therethrough. The neck 11 may extend from the body of the receptacle 10 along a neck axis Y. The neck 11 may be connected to a shoulder 16 of the receptacle 10, and the shoulder 16 may extend from the neck 11 in a direction substantially perpendicular to the neck axis Y. The neck axis Y may be non-parallel to the longitudinal axis X of the receptacle 10. For example, the neck axis Y may form an angle $\alpha$ relative to the longitudinal axis X. By way of example only, this angle $\alpha$ may be approximately 22° in the exemplary embodiment shown in FIGS. 1–3.

The receptacle 10 may comprise a first face 12 and a second face 13 substantially opposite to the first face 12. When not in use, the receptacle 10 may be placed on a horizontal surface with the first face 12 in contact with the horizontal surface.

In an exemplary embodiment of the invention, the wall of the receptacle 10 that defines the first face 12 may be formed of a constant thickness, but may also be formed of a non-constant thickness.

In the exemplary embodiment shown in FIG. 3, the receptacle 10 may be of a shape that is substantially symmetrical with respect to a midplane containing the axes X and Y.

In its central region, the second face 13 may include an indentation 14 defining a zone which the user can manually press to flow the substance out of the orifice 26, as described in greater detail below. Pressing the indentation may cause reduction in an inner volume of the receptacle so that the product contained in the receptacle may be dispensed out of the outlet orifice.

The receptacle 10 may be made integrally with the neck 11 by, for example, molding a plastic material. In a particular embodiment, the receptacle 10 and the neck 11 may integrally be made by a blow-molding technique.

The wall of the receptacle 10 may be sufficiently flexible, such that each time pressure is exerted on the receptacle 10 to dispense the substance it contains, the wall can return to its initial shape due to its sufficient elasticity.

The dispenser head 20 may be made and assembled with the the receptacle 1 in numerous ways. As shown in FIGS. 1 and 2, the dispenser head 20 may comprise an assembly portion 21 configured to engage the neck 11 at a predetermined position on the neck 11. For example, the assembly portion 21 may comprise a skirt having an internal thread that may engage with a thread 15 formed on the neck 11.

Figure 4:
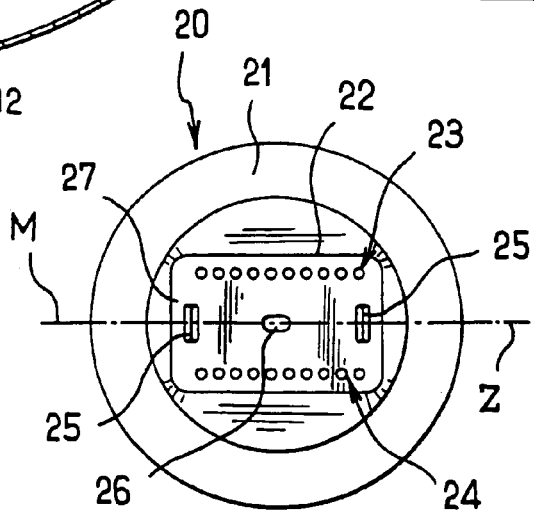
FIG. 4 is a plan view of the device of FIG. 1 along the direction of arrow IV, showing the dispenser head.

As shown in FIGS. 1 and 2, the dispenser head 20 may also comprise an applicator portion 22 having two rows of teeth 23, 24. These rows of teeth 23, 24 may extend in a direction substantially parallel to an axis Z, as shown in FIG. 4. The axis Z may be substantially perpendicular to the axis Y defined by the neck 11, once the dispenser head 20 is fastened thereon.

The applicator portion 22 may also comprise two end teeth 25 on both ends of, and in between, the two rows of teeth 23, 24. Each of the two end teeth 25 may be of a generally flat shape in a direction perpendicular to the axis Z. The end teeth 25 may have bases situated substantially along a symmetry plane M of the applicator portion 22 containing the axis Z.

In the exemplary embodiment shown in FIG. 4, each row of teeth 23, 24 may comprise ten teeth. It should be understood, however, that each row may comprise more or less than ten teeth, or may be replaced by applicator elements of a different kind, such as, for example, tufts of bristles.

The applicator portion 22 of the dispenser head 20 may define an outlet orifice 26 between the rows of teeth 23, 24 for delivering the substance contained in the receptacle 1. The orifice 26 may be made through the wall 27 of the applicator portion 22 from which the teeth project.

The applicator portion 22 may comprise more than one orifice 26. In various exemplary embodiments, at least one outlet orifice 26 may be located closer to the end of a tooth than the base of the tooth and/or, if the tooth is hollow, at the end of at least one tooth.

Figure 5:
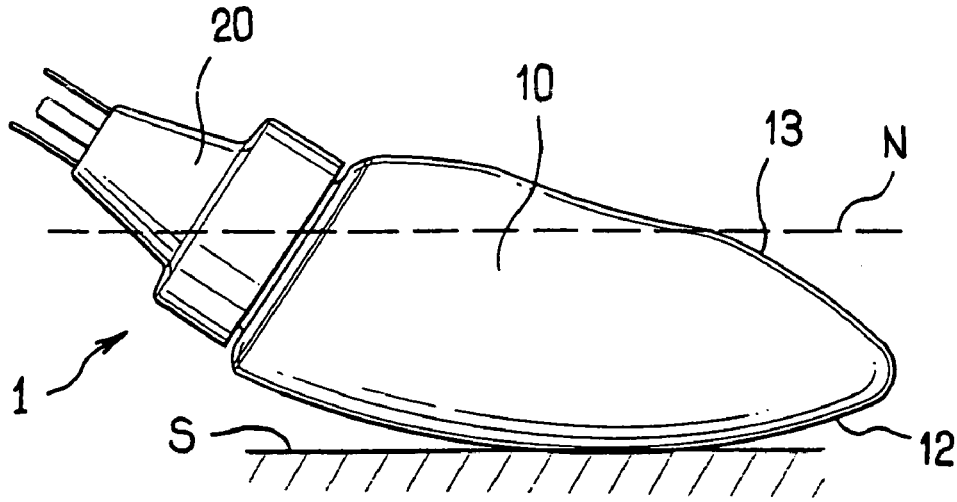
FIGS. 5–7 are schematic diagrams illustrating how the receptacle progressively may tilt as a substance quantity contained in the receptacle decreases.
Figure 6:
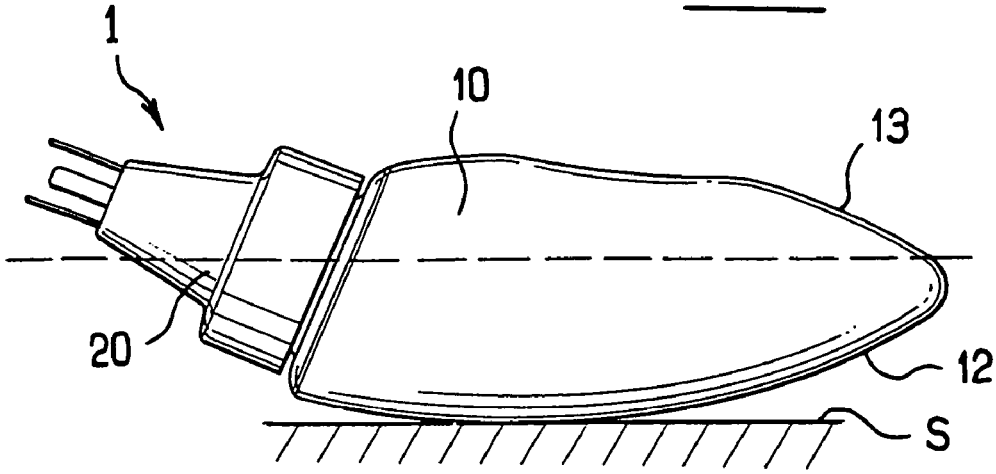
Figure 7:
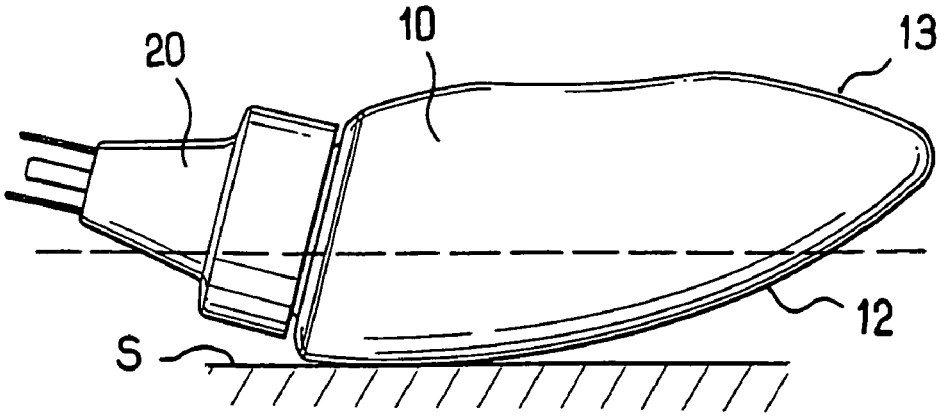

In accordance with an aspect of the invention, the first face 12 may be configured in such a manner that when the receptacle 10 is placed on a horizontal plane surface S, the elevational position of the orifice 26 moves downwardly as the quantity of substance in the receptacle 10 is progressively emptied, as shown in FIGS. 5–7. In these figures, a dashed line N represents the level of the substance contained in the receptacle 10.

In FIG. 5, the receptacle 10 is substantially full of a substance and the center of gravity of the device 1 is relatively far away from the dispenser head 20. At this condition, the orifice 26 of the dispenser head 20 may point upwardly (e.g., at about 45° relative to the surface S). In FIG. 6, as the quantity of substance in the receptacle 10 decreases, due to the shape of the receptacle, in particular, the shape of its first face 12, the center of gravity may shift towards the dispenser head 20. FIG. 7 shows the orientation of the device 1 after the receptacle 10 is emptied even more. Therefore, as is apparent, the equilibrium position of the empty device 1 may be different from an equilibrium position of the device filled with the substance, and the orientation of the device varies as a function of the quantity of substance contained in the receptacle 10.

In accordance with another aspect of the invention, the first face 12 of the receptacle 10 may be configured to enable the receptacle 10 to tilt on the surface S under the effect of the shift in the center of gravity, thereby enabling the device 1 to reach a position of stable equilibrium regardless of the quantity of substance contained in the receptacle 10. In an exemplary embodiment, the first face 12 may be almost spherical shaped, without any flat portion thereof.

Beyond the indentation 14, the distance between the first and second faces 12 and 13, as measured perpendicularly to the axis X of the receptacle 10, may decrease as it approaches from the neck 11 down to the end of the receptacle 10.

In accordance with another aspect of the invention, the downward tilt of the orifice 26 may enable a certain quantity of substance to be maintained in and/or close to the dispenser head 20. Thus, when the user presses the indentation 14 on the second face 13, the user may expel the substance out of the orifice 26 without having to wait for a long period a time to allow the substance to flow, under gravity, towards the outlet orifice 26. This may make the receptacle 1 easier to use.

In still another aspect of the invention, the first face 12 may be configured in such a manner that, regardless of the equilibrium position of the receptacle 1, while the device 1 is resting on the horizontal plane surface S with the first face 12 being in contact with the horizontal plane surface S, the level N of substance in the receptacle remains below the outlet orifice 26.

In various exemplary embodiments, the axis Z defined by the rows of teeth 23, 24 may remain substantially parallel to the horizontal plane surface S while the receptacle is tilting, as shown in FIGS. 5–7.

When the receptacle is empty, the device 1 may rest on the surface S with the axis Y of the neck 11 in a nearly horizontal position (e.g., substantially parallel to the surface S).

In order to use the device 1, the user may separate, where necessary, the dispenser head 20 from the receptacle 10 so as to be able to insert a substance into the receptacle 10. If mixing of multiple substances are desired, multiple substances may be inserted into the receptacle. For example, to obtain a hair-coloring product, an oxidizer and the corresponding coloring agent, which may be packaged separately, may be inserted into the receptacle. Thereafter, the user may then put the dispenser head 20 back on the neck 11. The flat shape of the receptacle may enhance mixing of the substances.

Thereafter, the user may dispense the hair-coloring product by pressing the indentation 14 so as to bring the first and second faces 12, 13 closer together. When the user puts the device 1 down after treating a lock of hair, the receptacle 10 may shift a certain quantity of substance closer to the outlet orifice 26, as explained above.

The invention is not limited to the embodiments described above. Various modifications can be applied, for example, to the shape of the receptacle 10 and/or the shape of the applicator portion 22.

The applicator portion may be fastened to the receptacle by any mechanism other than the screw-fastening. The applicator portion may also be made integrally with the receptacle.

Figure 8:
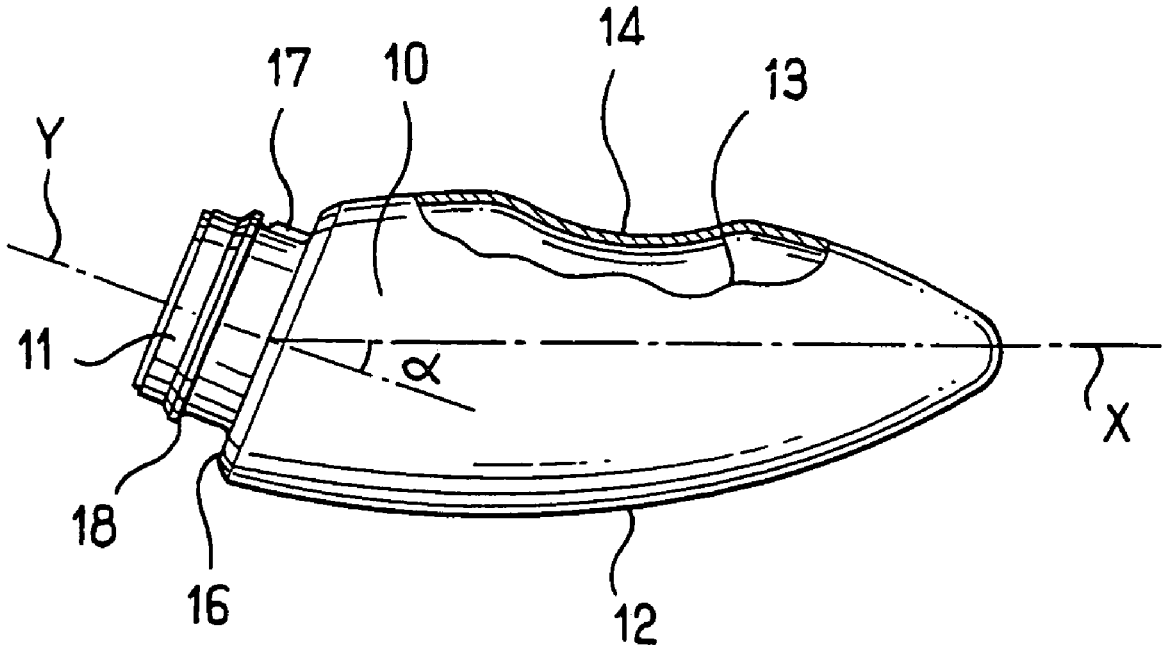
FIG. 8 is a side cross-sectional view of a receptacle, according to another exemplary embodiment of the invention.

By way of example, FIG. 8 shows a receptacle 10 whose neck 11 comprises an annular bead 18 enabling a dispenser head 20 to be snap-fastened thereon, according to another exemplary embodiment of the invention. The neck 11 may also include a relief portion 17 located between the bead 18 and the shoulder 16. As shown in the figure, the relief portion 17 may be in the form of a spline extending parallel to the axis Y defined by the neck 11. The relief portion 17 may cooperate with a complementary relief (not shown in the drawings) within the dispenser head 20 so that the dispenser head 20 may be fastened onto the receptacle 10 in a particular orientation.

Throughout the description, including the claims, the expression "a" should be understood as being synonymous with "at least one" (i.e., relating to both the singular and the plural) unless otherwise specified to the contrary.

It will be apparent to those skilled in the art that various modifications and variations can be made to the structure of the present invention. Thus, it should be understood that the invention is not limited to the examples discussed in the specification. Rather, the present invention is intended to cover modifications and variations.

What is claimed is:

1. A dispensing device comprising:

a receptacle comprising a first face, the receptacle being configured to contain a substance and being configured to be rested on a horizontal plane surface with the first face being in contact with the horizontal plane surface; and an applicator portion comprising at least one outlet orifice for dispensing the substance contained in the receptacle;

wherein the first face is configured such that while the receptacle is rested on the horizontal plane surface with the first face being in contact with the horizontal plane surface, a decrease in the quantity of substance in the receptacle causes the receptacle to tilt without causing the substance to run out through said at least one outlet orifice.

2. The dispensing device according to claim 1, wherein the first face is configured such that the tilting of the receptacle in response to a decrease in the quantity of the substance in the receptacle causes the outlet orifice to move closer to the horizontal plane surface.

3. The dispensing device according to claim 1, wherein the receptacle is configured such that, while the receptacle is rested on the horizontal plane surface with the first face being in contact with the horizontal plane surface and while the receptacle contains the substance, the center of gravity of the receptacle shifts towards the outlet orifice as the quantity of substance in the receptacle decreases.

4. The dispensing device according to claim 1, wherein the receptacle is configured such that, while the receptacle is rested on the horizontal plane surface with the first face being in contact with the horizontal plane surface and while the receptacle contains the substance, the receptacle tilts about geometric instantaneous pivot axes that are parallel to one another and to the horizontal plane surface as the quantity of substance in the receptacle decreases.

5. The dispensing device according to claim 1, wherein the receptacle is configured such that, while the receptacle is rested on the horizontal plane surface with the first face being in contact with the horizontal plane surface, any quantity of substance contained in the receptacle defines in one-to-one correspondence a corresponding stable equilibrium position of the receptacle.

6. The dispensing device according to claim 1, wherein the receptacle is configured such that the receptacle rests in stable equilibrium regardless of the level of substance in the receptacle.

7. The dispensing device according to claim 1, wherein said first face is defined by a wall having a substantially constant thickness.

8. The dispensing device according to claim 1, wherein the receptacle is not provided with any ballast.

9. The dispensing device according to claim 1, wherein the receptacle has a length and a width, wherein the width ranges from about 75% to about 125% of the length.

10. The dispensing device according to claim 9, wherein the width ranges from about 85% to about 115% of the length.

11. The dispensing device according to claim 1, further comprising a dispenser head.

12. The dispensing device according to claim 11, wherein the receptacle comprises an elongated body defining a longitudinal axis, and wherein the dispenser head extends along a dispenser head axis that is non-parallel to said longitudinal axis.

13. The dispensing device according to claim 12, wherein an angle between the dispenser head axis and the longitudinal axis of the elongated body ranges from about 10° to about 30°.

14. The dispensing device according to claim 13, wherein an angle between the dispenser head axis and the longitudinal axis of the elongated body ranges from about 15° to about 25°.

15. The dispensing device according to claim 11, wherein the receptacle comprises a neck on which the dispenser head is fastened.

16. The dispensing device according to claim 15, further comprising a screw fastener to fasten the dispenser head to the neck.

17. The dispensing device according to claim 15, further comprising a snap fastener to fasten the dispenser head to the neck.

18. The dispensing device according to claim 11, wherein the applicator portion is disposed on the dispenser head.

19. The dispensing device according to claim 1, wherein the applicator portion is configured to comb hair.

20. The dispensing device according to claim 19, wherein the applicator portion comprises at least one tooth.

21. The dispensing device of claim 20, further comprising a dispenser head extending along a dispenser head axis, wherein the tooth extends in a direction substantially parallel to the dispenser head axis.

22. The dispensing device according to claim 19, wherein the applicator portion comprises two substantially parallel rows of teeth.

23. The dispensing device according to claim 22, wherein the outlet orifice opens out between the two substantially parallel rows of teeth.

24. The dispensing device according to claim 19, wherein the applicator portion comprises at least one row of teeth.

25. The dispensing device according to claim 1, wherein the applicator portion comprises at least one row of teeth, said row extending in a direction substantially parallel to the horizontal plane surface when the receptacle is rested thereon with the first face being in contact therewith.

26. The dispensing device according to claim 1, wherein the first face has an outwardly-facing, generally convex shape.

27. The dispensing device according to claim 1, wherein the receptacle comprises a second face opposite the first face, wherein the second face comprises at least one indentation.

28. The dispensing device according to claim 27, wherein the indentation is positioned substantially at the center of the second face.

29. The dispensing device according to claim 28, wherein a portion of the second face other than the indentation has an outwardly-facing, generally concave shape.

30. The dispensing device according to claim 1, further comprising a cosmetic product contained in the receptacle.

31. The dispensing device according to claim 30, wherein the cosmetic product comprises a hair product.

32. The dispensing device according to claim 31, wherein the hair product comprises a hair-coloring product.

33. The dispensing device according to claim 1, wherein a substance-containing capacity of the receptacle ranges from about 10 mL to about 500 mL.

34. The dispensing device according to claim 33, wherein the substance-containing capacity of the receptacle is about 150 mL.

35. The dispensing device of claim 1, wherein the device is configured such that product is dispensed from the outlet orifice by manually pressing the receptacle so as to reduce an inner volume of the receptacle.

36. A dispensing device comprising:

a receptacle comprising a first face and a second face substantially opposite the first face, the receptacle being configured to contain a substance and being configured to be rested on a horizontal plane surface with the first face being in contact with the horizontal plane surface; and at least one outlet orifice for dispensing the substance contained in the receptacle;

wherein the first face is configured such that while the receptacle is rested on the horizontal plane surface with the first face being in contact with the horizontal plane surface, a decrease in the quantity of substance in the receptacle causes the receptacle to tilt without causing the substance to run out through said at least one outlet orifice; and wherein the second face comprises an indentation.

37. The dispensing device of claim 36, wherein the indentation is situated at substantially the center of the second face.

38. The dispensing device of claim 36, wherein the device is configured such that product is dispensed from the outlet orifice by manually pressing the receptacle so as to reduce an inner volume of the receptacle.

39. A dispensing device comprising:

a receptacle comprising a first face, the receptacle being configured to contain a substance and being configured to be rested on a horizontal plane surface with the first face being in contact with the horizontal plane surface; and at least one outlet orifice for dispensing the substance contained in the receptacle;

wherein the first face is configured such that while the receptacle is rested on the horizontal plane surface with the first face being in contact with the horizontal plane surface, a decrease in the quantity of substance in the receptacle causes the receptacle to tilt without causing the substance to run out through said at least one outlet orifice; and wherein the receptacle is configured such that, while the receptacle is rested on the horizontal plane surface with the first face being in contact with the horizontal plane surface, any quantity of substance contained in the receptacle defines in one-to-one correspondence a corresponding stable equilibrium position of the receptacle.

40. A dispensing device comprising:

a receptacle comprising a first face, the receptacle being configured to contain a substance and being configured to be rested on a horizontal plane surface with the first face being in contact with the horizontal plane surface;

a dispenser head; and at least one outlet orifice for dispensing the substance contained in the receptacle;

wherein the first face is configured such that while the receptacle is rested on the horizontal plane surface with the first face being in contact with the horizontal plane surface, a decrease in the quantity of substance in the receptacle causes the receptacle to tilt without causing the substance to run out through said at least one outlet orifice;

wherein the receptacle comprises an elongated body defining a longitudinal axis; and wherein the dispenser head extends along a dispenser head axis that is non-parallel to said longitudinal axis.

41. A dispensing device comprising:

a receptacle comprising a first face, the receptacle being configured to contain a substance and being configured to be rested on a horizontal plane surface with the first face being in contact with the horizontal plane surface; and at least one outlet orifice for dispensing the substance contained in the receptacle;

wherein the first face is configured such that while the receptacle is rested on the horizontal plane surface with the first face being in contact with the horizontal plane surface, a decrease in the quantity of substance in the receptacle causes the receptacle to tilt without causing the substance to run out through said at least one outlet orifice; and wherein the device is configured such that product is dispensed from the outlet orifice by manually pressing the receptacle so as to reduce an inner volume of the receptacle.

42. A dispensing device comprising:

a receptacle comprising a first face, the receptacle being configured to contain a substance and being configured to be rested on a horizontal plane surface with the first face being in contact with the horizontal plane surface;

at least one outlet orifice for dispensing the substance contained in the receptacle; and a substance contained in the receptacle;

wherein the first face is configured such that while the receptacle is rested on the horizontal plane surface with the first face being in contact with the horizontal plane surface, a decrease in the quantity of substance in the receptacle causes the receptacle to tilt without causing the substance to run out through said at least one outlet orifice;

wherein the receptacle lacks a ballast; and wherein the device is configured so that the substance has a level substantially parallel to the horizontal plane surface while the receptacle is rested on the horizontal plane surface with the first face being in contact with the horizontal plane surface.

43. The dispensing device of claim 42, wherein the at least one outlet orifice defines an elevation with respect to the horizontal plane surface, and wherein the device is configured such that the level of the substance in the receptacle remains below the elevation while the receptacle is rested on the horizontal plane surface with the first face being in contact with the horizontal plane surface.

* * * * *